US010028879B2

(12) United States Patent
Kim

(10) Patent No.: US 10,028,879 B2
(45) Date of Patent: Jul. 24, 2018

(54) APPARATUS FOR AUTOMATICALLY LENGTHENING CALF MUSCLE

(71) Applicant: INJE UNIVERSITY INDUSTRY-ACADEMIC COOPERATION FOUNDATION, Gimhae-si (KR)

(72) Inventor: Hyun-Dong Kim, Busan (KR)

(73) Assignee: INJE UNIVERSITY INDUSTRY-ACADEMIC COOPERATION FOUNDATION (KR)

( * ) Notice: Subject to any disclaimer, the term of this patent is extended or adjusted under 35 U.S.C. 154(b) by 1025 days.

(21) Appl. No.: 14/451,315

(22) Filed: Aug. 4, 2014

(65) Prior Publication Data

US 2014/0343464 A1 Nov. 20, 2014

Related U.S. Application Data

(63) Continuation-in-part of application No. PCT/KR2014/001525, filed on Feb. 25, 2014.

(30) Foreign Application Priority Data

Feb. 25, 2013 (KR) ..... 10-2013-0020116

(51) Int. Cl.
*A61H 1/02* (2006.01)

(52) U.S. Cl.
CPC ..... *A61H 1/0237* (2013.01); *A61H 1/0266* (2013.01); *A61H 2201/1215* (2013.01); *A61H 2201/165* (2013.01); *A61H 2201/5061* (2013.01)

(58) Field of Classification Search
CPC ..... A61H 1/0237; A61H 1/0266; A61H 2201/1207; A61H 2201/1215;
(Continued)

(56) References Cited

U.S. PATENT DOCUMENTS 4,538,595 A * 9/1985 Hajianpour ..... A61H 1/0266 482/901
5,044,360 A * 9/1991 Janke ..... A61F 5/0127 403/113
(Continued)

FOREIGN PATENT DOCUMENTS

JP 07290770 A2 11/1995
JP 11226069 A2 8/1999
(Continued)

*Primary Examiner* — Michael Tsai
(74) *Attorney, Agent, or Firm* — JHK Law; Joseph Hyosuk Kim

(57) ABSTRACT

There is provided an apparatus for automatically lengthening a calf muscle in order to relax fatigue and tension of a calf muscle of a worker who works standing up for a long time or a woman wearing high heels. Accordingly, a calf muscle can be naturally relaxed itself by lengthening a length of the calf muscle that is tense by a repetitive and continuous damage, so that it is possible to reduce a chronic muscle unbalance and a muscular pain of a worker who works standing up for a long time or a young woman wearing high heels and it is possible to improve quality of life and work efficiency in an industrial site.

5 Claims, 9 Drawing Sheets

(58) Field of Classification Search
CPC .... A61H 2201/1436; A61H 2201/1454; A61H 2201/1463; A61H 2201/164; A61H 2201/1642; A61H 2201/1676; A61H 2201/1678; A61H 2201/5061; A61H 2205/10; A61H 2205/106; A61H 2205/12; A61H 1/02; A61H 2001/0207; A61H 1/00
See application file for complete search history.

(56) References Cited

U.S. PATENT DOCUMENTS 5,520,627 A * 5/1996 Malewicz ..... A61F 5/0125 602/16
5,738,636 A * 4/1998 Saringer ..... A61H 1/0266 601/29
6,146,341 A * 11/2000 Sato ..... A61H 1/0237 482/44
2004/0172097 A1* 9/2004 Brodard ..... A61H 1/0266 607/49
2007/0027410 A1* 2/2007 Cost ..... A61H 1/0266 601/5
2008/0108918 A1* 5/2008 Joutras ..... A61H 1/02 601/34
2010/0038983 A1* 2/2010 Bhugra ..... A61F 2/68 310/83
2010/0160986 A1* 6/2010 Simmons ..... A61H 1/0237 607/3
2012/0289870 A1* 11/2012 Hsiao-Wecksler ... A61H 1/0266 601/5

FOREIGN PATENT DOCUMENTS

JP 2001029409 A2 2/2001
JP 2006158431 A2 6/2006
KR 10-2006-0038006 11/2006
KR 10-2009-0097614 9/2009

* cited by examiner

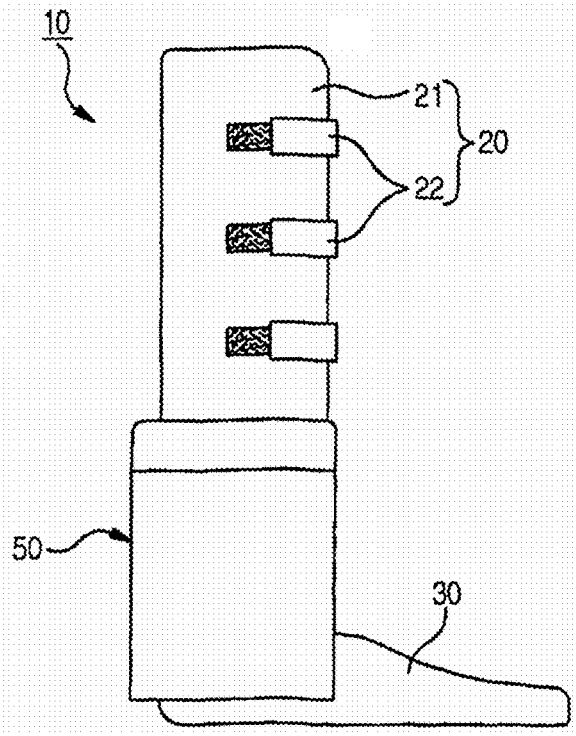
[Fig. 1]

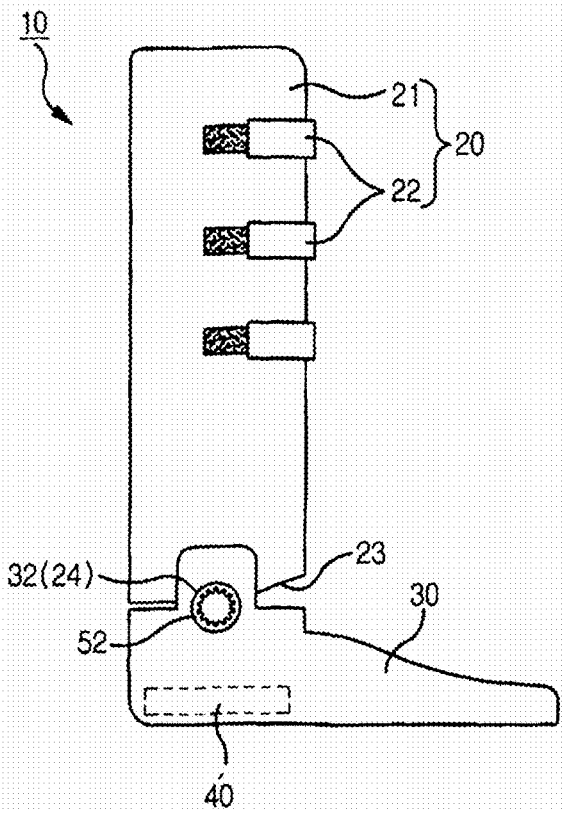
[Fig. 2]

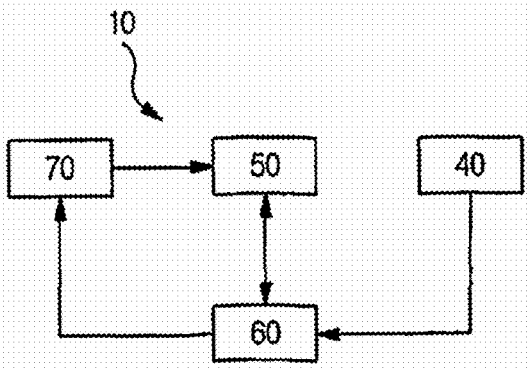
[Fig. 3]

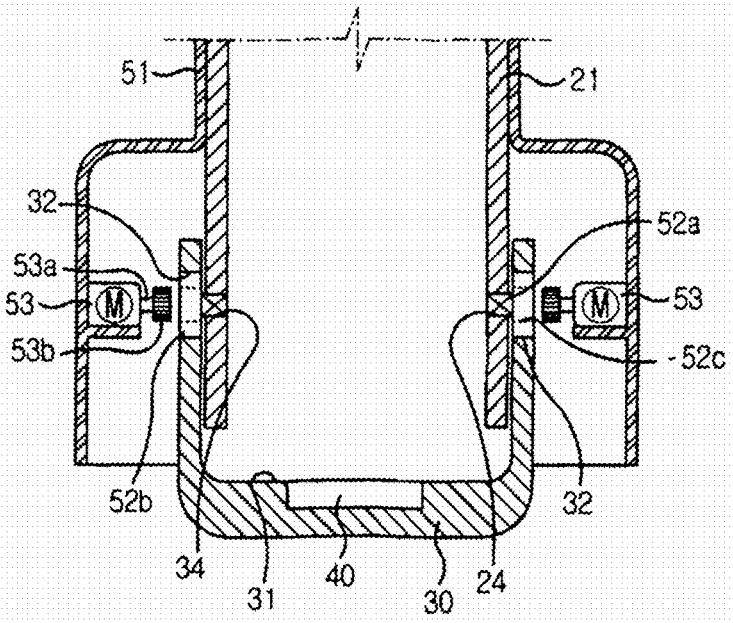
[Fig. 4]

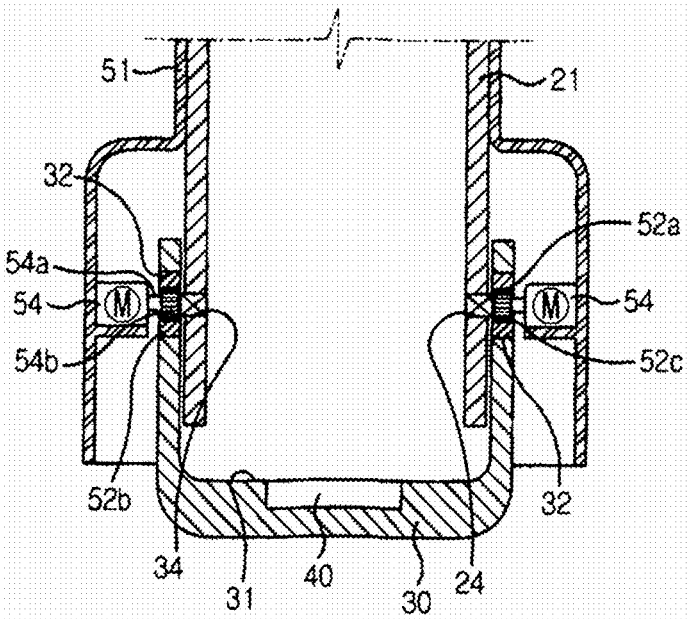
[Fig. 5]

[Fig. 6a]
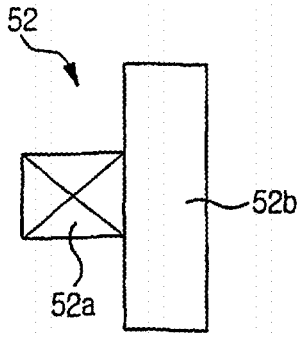
[Fig. 6b]
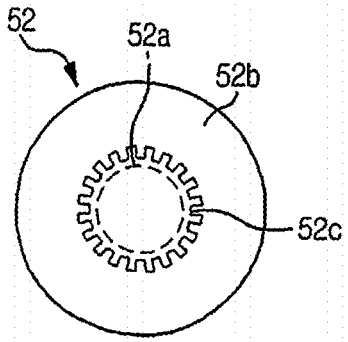

[Fig. 7a]
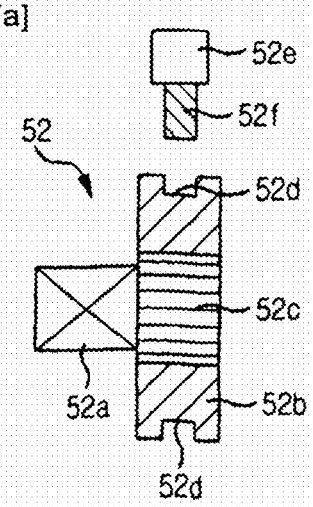
[Fig. 7b]
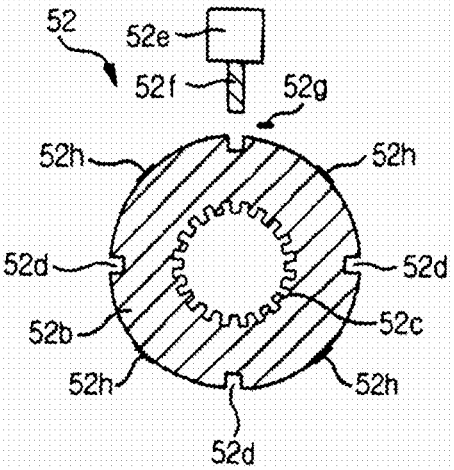

[Fig. 8a]
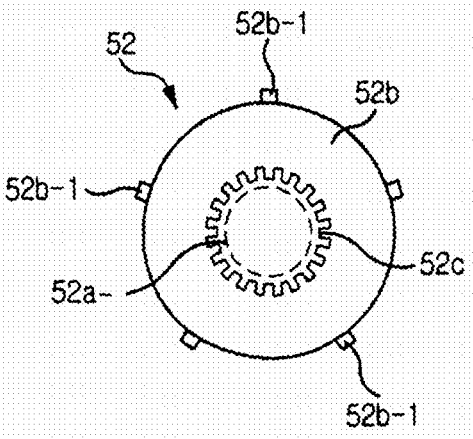
[Fig. 8b]
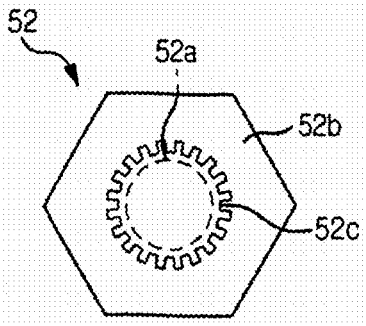

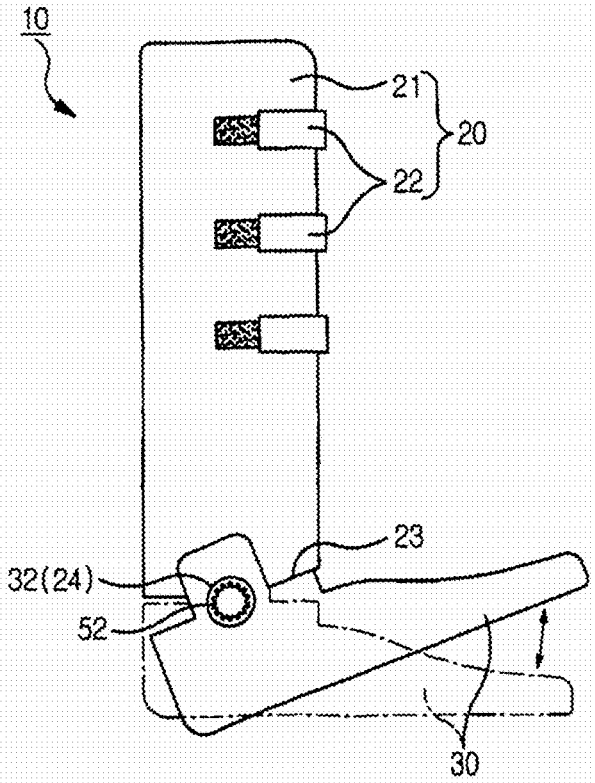
[Fig. 9]

APPARATUS FOR AUTOMATICALLY LENGTHENING CALF MUSCLE

TECHNICAL FIELD

The present disclosure relates to an apparatus for automatically lengthening a calf muscle in order to relax fatigue and tension of a calf muscle of a worker who works standing up for a long time or a woman wearing high heels, and more particularly, relates to an apparatus for automatically lengthening a calf muscle that is operated in response to a degree of selectively pressurizing a sensor by a heel of a user in order to forcibly maintain a dorsiflexion state of an ankle joint to lengthen a calf muscle so as to reduce pain and contraction of a muscle caused by excessive tension and fatigue due to excessive use of the calf muscle as a posture maintaining muscle.

BACKGROUND

As a service industry is developed, occupational clusters who work standing up for a long time in department stores or hyper markets have been increased. In this case, although employees feel fatigue or pain of a leg muscle, but the employees have no choice but to put up with the fatigue or pain in a place of work.

Further, in many cases, a young woman wears high heels because the high heels make her look taller and her legs look longer and slimmer Thus, the woman feels pain and fatigue of a calf muscle, but the woman also has no choice but to put up with the fatigue and pain for beauty.

In order to relax pain and excessive tension caused in the excessively used calf muscle as a posture maintaining muscle, the woman often massages her legs with a beer bottle.

Although the high heels make her look taller and her legs look longer, the calf muscle becomes thick and short. The woman empirically massages the calf muscle with the beer bottle in order to prevent the legs from being thick, but gets Botox injections to the calf muscle as medical treatment in severe cases.

Meanwhile, when the woman stands up for a long time or continues walking with her high-heeled shoes on for fixing her feet in a posture in which a lower leg muscle becomes shorter than a normal length, a repetitive strain injury syndrome caused by repetitively doing the same physical motion may be caused.

More specifically, according to the repetitive strain injury syndrome, a muscle or a soft tissue that is not relaxed is not recovered to its normal state, and the tissue diminishes by the progression of the injury faster than the recovery. Furthermore, when the muscle is repetitively used, the muscle is excessively contracted. At this time, while the muscle is contracted in a fixed state, blood circulation is poor, and wastes are accumulated to simulate nerves. For this reason, since blood vessels are contracted to further impair poor blood circulation, pain gets worse as time goes on. In addition, blood flow of the leg is reduced, and when one muscle is damaged, muscles around the damaged muscle are tense. When the muscles are further tense, since blood flow is reduced, appearance and disappearance of the pain are repeated.

The biggest problem is that the muscle that is repetitively, continuously and excessively used is toughened and shortened, inherency of the muscles in such a regression process is lost, and the muscles may not be relaxed or lengthened themselves.

However, since equipment capable of solving the problems is practically provided, most people apply a hot towel to the leg or massage the leg, but a fundamental problem is not solved.

SUMMARY

The present disclosure has been made in an effort to provide an apparatus for automatically lengthening a calf muscle capable of selectively lengthening a muscle length of a calf muscle by allowing a user wearing the apparatus to recognize fatigue, tension and pain of the calf muscle to slowly and to pressurize a pressure detecting unit in order to recover the calf muscle that is repetitively and continuously damaged.

An exemplary embodiment of the present disclosure provides an apparatus for automatically lengthening a calf muscle including a lower leg fixing part that covers the entire lower leg; a foot accommodating part that is rotatably coupled to a lower part of the lower leg fixing part; a pressure detecting unit that is attached to a heel part of the foot accommodating part to detect a pressure; a rotation driving unit that is attached to connection portions of the lower leg fixing part and the foot accommodating part to rotate the foot accommodating part depending on an operation of the pressure detecting unit; a controller that controls the rotation driving unit in response to a signal transmitted from the pressure detecting unit; and a power supply that supplies a power to the rotation driving unit in response to a signal of the controller.

According to the exemplary embodiments of the present disclosure, in the apparatus for automatically lengthening a calf muscle, since the calf muscle can be relaxed to be recovered itself by further quickly securing a normal muscle length of the calf muscle, it is possible to reduce a chronic muscle unbalance and a muscular pain of a worker who works standing up for a long time or a young woman wearing high heels, and it is possible to improve quality of life and work efficiency in an industrial site.

Further, it is possible to allow a soldier who frequently marches, a sports player who frequently runs, and a hiker who frequently uses the calf muscle to quickly recover their conditions by quickly securing the muscle length of the calf muscle after extreme exercise.

The foregoing summary is illustrative only and is not intended to be in any way limiting. In addition to the illustrative aspects, embodiments, and features described above, further aspects, embodiments, and features will become apparent by reference to the drawings and the following detailed description.

BRIEF DESCRIPTION OF THE DRAWINGS

FIG. 1 is a side view of an apparatus for automatically lengthening a calf muscle according to the present disclosure.

FIG. 2 is a side view of the apparatus for automatically lengthening a calf muscle according to the present disclosure from which a driving case is separated.

FIG. 3 is a configuration diagram illustrating an operation state of the apparatus for automatically lengthening a calf muscle according to the present disclosure.

FIGS. 4 and 5 are enlarged views of major parts of the apparatus for automatically lengthening a calf muscle according to the present disclosure.

FIGS. 6 to 8 are diagrams illustrating examples of a rotational body of the apparatus for automatically lengthening a calf muscle according to the present disclosure.

FIG. 9 is a diagram illustrating a state where the apparatus for automatically lengthening a calf muscle according to the present disclosure is used.

DETAILED DESCRIPTION

In the following detailed description, reference is made to the accompanying drawing, which forms a part hereof. The illustrative embodiments described in the detailed description, drawing, and claims are not meant to be limiting. Other embodiments may be utilized, and other changes may be made, without departing from the spirit or scope of the subject matter presented here.

Hereinafter, a configuration of the present disclosure will be described with reference to the accompanying drawings. FIG. 1 is a side view of an apparatus for automatically lengthening a calf muscle according to the present disclosure, FIG. 2 is a side view of the apparatus for automatically lengthening a calf muscle according to the present disclosure from which a driving case is separated, FIG. 3 is a configuration diagram illustrating an operation state of the apparatus for automatically lengthening a calf muscle according to the present disclosure, FIGS. 4 and 5 are enlarged views of major parts of the apparatus for automatically lengthening a calf muscle according to the present disclosure, and FIGS. 6 to 8 are diagrams illustrating examples of a rotational body of the apparatus for automatically lengthening a calf muscle according to the present disclosure.

An apparatus for automatically lengthening a calf muscle 10 according to the present disclosure includes a lower leg fixing part 20 that covers the entire lower leg, a foot accommodating part 30 that is rotatably coupled to a lower part of the lower leg fixing part 20, a pressure detecting unit 40 that is attached to a heel part 31 of the foot accommodating part 30 to detect a pressure, a rotation driving part 50 that is attached to connection portions of the lower leg fixing part 20 and the foot accommodating part 30 to rotate the foot accommodating part depending on an operation of the pressure detecting unit 40, a controller 60 that controls the rotation driving part 50 in response to a signal transmitted from the pressure detecting unit 40, and a power supply 70 that supplies a power to the rotation driving unit 50 in response to a signal of the controller 60.

The lower leg fixing part 20 that covers the entire lower leg has a predetermined height and size so as to be able to accommodate the lower leg.

Preferably, the height of the lower leg fixing part 20 does not exceed 10 cm below the knee joint and 1.5 to 2.0 cm below head of the fibular so as not to pressurize a protruding bone of the lower leg or pressurize a fibular nerve.

Further, the lower leg fixing part 20 includes a lower leg accommodating member 21 that has an opened front surface and accommodates the lower leg of a user, and lower leg fixing members 22 that are attached to the front surface of the lower leg accommodating member 21 at a predetermined distance to fix the lower leg accommodating member 21

That is, the lower leg fixing part 20 is provided to fix the lower leg of the user accommodated within the lower leg accommodating member 21 by using the lower leg fixing members 22.

At this time, the lower leg fixing members 22 that fix the lower leg accommodating member 21 may be a Velcro tape, a snap, or a belt that can adjust a length.

Furthermore, a dorsiflexion part 23 is formed at a lower part of the lower leg fixing part 20 to be inclined so as to be able to restrict a rotation angle of the foot accommodating part 30, and an inclined angle of the dorsiflexion part 23 is preferably around 20 degrees in consideration of a rotation angle of the ankle joint.

This is because the calf muscle is prevent from being unnecessarily and excessively lengthened by a mechanical device to be damaged by taking into account the fact that a discharge bending angle of the ankle joint of healthy people does not exceed 20 degrees.

The foot accommodating part 30 that is rotatably coupled to the lower part of the lower leg fixing part 20 is formed in a shoe shape, and a top thereof is open for user convenience.

That is, the foot accommodating part 30 opens the top so as to be able to easily accommodate the lower leg of the user in the lower leg fixing part 20, and is configured to support the foot of the user by a foot plate.

According to the detachment/attachment method, the accommodation method and the external appearance of the shoe shape of the apparatus, it is possible to allow anyone to easily recognize and use the apparatus.

The pressure detecting unit 40 attached to the foot accommodating part 30 is attached to the heel part 31 of the foot accommodating part 30.

The pressure detecting unit 40 may be a component such as a known pressure sensor that can detect a pressure.

That is, at least one or more pressure detecting units 40 are attached to the heel part 31 of the foot accommodating part 30, detect the pressure transmitted to the heel of the user, and transmit the detected pressure to the controller 60.

The rotation driving unit 50 attached to the connection portions of the lower leg fixing part 20 and the foot accommodating part 30 rotates the foot accommodating part 30 depending on the operation of the pressure detecting unit 40.

The rotation driving unit 50 has the following configuration illustrated in FIG. 4 or 5.

First, the rotation driving unit 50 of FIG. 4 includes a driving case 51 that is attached to an outer surface of the lower leg fixing part 20, rotational bodies 52 that are disposed at overlapped portions of the lower leg fixing part 20 and the foot accommodating part 30 to rotate the foot accommodating part 30 at the time of rotating, and a pair of starting motors 53 that is attached to the driving case 51 positioned in the same line with the rotational bodies 52 and in which rods 53*a* provided with rotational shafts 53*b* are moved back and forth.

Furthermore, a top of the driving case 51 is coupled to a top of the lower leg fixing part 20, and a front surface and a bottom thereof are open.

Moreover, the rotational body 52 includes a rotating member 52*a* that is attached to a connection portion 24 of the lower leg fixing part 20 and is configured as a roller or a bearing rotated in place, and a fixing member 52*b* that is attached to a connection portion 32 of the foot accommodating part 30, is coupled to the rotating member 52*a*, and is provided with a gear 52*c* or a spline therein.

That is, when the starting motors 53 is rotated, the rotating member 52*a* of the rotational body 52 is rotated in place at the connection portion 24 of the lower leg fixing part 20, and the fixing member 52*b* is rotated together with the foot accommodating part 30.

At this time, an outer surface of the fixing member 52*b* may have a polygonal shape so as to be able to prevent a slip and transmit rotational force of the starting motors 53 to the foot accommodating part 30, or fixing protrusions 52*b*-1 may be formed at the fixing member at a predetermined distance.

The rotational body 52 includes the rotating member 52*a* that is attached to the connection portion 24 of the lower leg fixing part 20 and is configured as a roller or a bearing rotated in place, the fixing member 52*b* that is attached to a connection portion 32 of the foot accommodating part 30, is coupled to the rotating member 52*a*, is provided with the gear 52*c* or a spline therein, and is provided with insertion coupling grooves 52*d* formed at the outside thereof at a predetermined distance, and an electromagnet 52*e* that is attached to an outer surface of the fixing member 52*b* with a predetermined gap formed therebetween and vertically operates insertion protrusions 52*f* depending on current to couple or separate the insertion protrusions to or from the insertion coupling grooves 52*d*.

That is, the rotational body 52 is operated in such a manner that when the starting motor 53 is rotated, the rotating member 52*a* is rotated in place at the connection portion 24 of the lower leg fixing part 20, the fixing member 52*b* is rotated together with the foot accommodating part 30, and the electromagnet 52*e* fixes the insertion protrusions 52*f* by attractive force and couples the insertion protrusions 52*f* to the insertion coupling grooves 52*d* by reaction force when the fixing member 52*b* is moved to a predetermined position to fix the fixing member 52*b*.

At this time, the rotational shaft 52*b* and the rod 52*a* of the starting motor 53 are retreated to be positioned at their original positions when the insertion protrusions 52*f* are coupled to the insertion coupling grooves 52*d*.

In addition, after the insertion protrusions 52*f* are separated from the insertion coupling grooves 52*d*, the foot accommodating part 30 is positioned at its original position by a weight of the user.

In addition, a detecting member 52*g* and a detecting sensor 52*h* may be respectively attached to the outer surface of the fixing member 52*b* and the electromagnet 52*e* in order to accurately operate the insertion coupling grooves 52*d* and the insertion protrusions 52*f*.

More specifically, the detecting sensor 52*h* positioned at the electromagnet 52*e* recognizes the detecting member 52*g* of the fixing member 52*b* being rotated, transmits the recognized result to the controller 60, converts a pole of the electromagnet 52*e*, for example, an N pole into an S pole or an S pole into an N pole, and allows the insertion protrusions 52*f* to protrude at accurate positions to be coupled to the insertion coupling grooves 52*d*.

Further, when the pole of the electromagnet 52*e* is converted, for example, the S pole into the N pole or N pole into the S pole in response to a signal of the controller 60, the electromagnet 52*e* attracts the insertion protrusions 52*f* by attractive force to fix, and the fixing member 52*b* is rotated by the weight of the user to be positioned at its original position.

Next, the rotation driving unit 50 of FIG. 5 includes a driving case 51 that is attached to an outer surface of the lower leg fixing part 20, rotational bodies 52 that are disposed at overlapped portions of the lower leg fixing part 20 and the foot accommodating part 30 to rotate the foot accommodating part 30 at the time of rotating, and a pair of forward/reverse driving motors 54 that is coupled to the rotational bodies 52 attached to the driving case positioned in the same line with the rotational bodies 52.

That is, when the rotation driving unit 50 receives a power through the power supply 70 in response to the signal of the controller 60, a rod 54*a* and a rotational shaft 54*b* of the forward/reverse driving motor 54 are rotated in one direction to rotate the foot accommodating part 30 upward.

Furthermore, in order to rotate the foot accommodating part 30 downward, the rotation driving unit is reversely rotated by an operation of a switch (not illustrated) controlling the forward/reverse driving motor 54 to position the foot accommodating part 30 at its original position.

Subsequently, the top of the driving case 51 is coupled to the top of the lower leg fixing part 20, and the front surface and the bottom thereof are open.

Moreover, the rotational body 52 includes the rotating member 52*a* that is attached to the connection portion 24 of the lower leg fixing part 20 and is configured as a roller or a bearing rotated in place, and is attached to the connection portion 32 of the foot accommodating part 30 to be coupled to the rotating member 52*a* and is provided with the gear 52*c* or the spline therein.

That is, when the forward/reverse driving motor 24 is rotated, the rotating member 52*a* of the rotational body 52 is rotated in place at the connection portion 24 of the lower leg fixing part 20, and the fixing member 52*b* is rotated together with the foot accommodating part 30.

At this time, an outer surface of the fixing member 52*b* may have a polygonal shape so as to be able to prevent a slip and transmit rotational force of the forward/reverse driving motor 54 to the foot accommodating part 30, and fixing protrusions 52*b*-1 may be formed at the fixing member at a predetermined The controller 60 that controls the rotation driving part 50 in response to the signal transmitted from the pressure detecting unit 40 transmits a power supply signal to the power supply 70 depending on the pressure transmitted through the pressure detecting unit 40 to control the number of rotating of the rotation driving unit 50.

That is, when the controller 60 transmits a pressure value through the pressure detecting unit 40, if the pressure value is small, a low-speed signal is transmitted to the rotation driving unit 50, and if the pressure value is large, a high-speed signal is transmitted to the rotation driving unit 50.

In addition, when the pressure signal value through the pressure detecting unit 40 is constant, the controller 60 may include a time control program so as to allow the rotation driving unit 50 to stop after being operated for one minute, two minutes, five minutes or 10 minutes.

The power supply 70 that supplies the power to the rotation driving unit 50 in response to the signal of the controller 60 is selectively adopted to a known socket connection structure in addition to a battery that can be easily carried or stored.

Next, a state where the apparatus for automatically lengthening a calf muscle having the aforementioned configuration is used will be described.

First, there is formed the lower leg fixing part 20 including the lower leg accommodating member 21 that has the opened front surface to accommodate the lower leg of the user and is provided with the dorsiflexion part 23 formed to be inclined at the lower part thereof and the lower fixing members 22 that are attached to the front surface of the lower leg accommodating member 21 at a predetermined and fixe the lower leg accommodating member 21.

Further, the foot accommodating part 30 that includes the pressure detecting unit 40 provided at the heel part 31 and the top opening is disposed below the lower leg fixing part 20.

Subsequently, the rotation driving unit 50 including the driving case 51 that is attached to the outer surface of the lower leg fixing part 20, the rotational bodies 52 that are disposed to the overlapped portions of the lower leg fixing part 20 and the foot accommodating part 30 to rotate the foot accommodating part 30 at the time of rotating, and the pair of starting motors 53 that is attached to the driving case 51 positioned in the same line with the rotational bodies 52 and in which the rods 53*a* provided with the rotational shafts 53*b* are moved back and forth is attached to the connection portions 24 and 32 of the lower leg fixing part 20 and the foot accommodating part 30.

At this time, the rotational body 52 includes the rotating member 52*a* that is attached to the connection portion 24 of the lower leg fixing part 20 and is configured as the roller or bearing rotated in place and the fixing member 52*b* that is attached to the connection portion 32 of the foot accommodating part 30 to be coupled to the rotating member 52*a*, and is provide with the gear 52*c* or the spline therein.

Furthermore, when the controller 60 that controls the rotation driving unit 50 in response to the signal transmitted from the pressure detecting unit 40 and the power supply 70 that supplies the power to the rotation driving unit 50 in response to the signal of the controller 60 are attached to the driving case 51 of the rotation driving unit 50, the assembly of the apparatus for automatically lengthening a calf muscle 10 is finished.

At this time, the controller 60 is not immediately operated when the pressure is detected through the pressure detecting unit 40, but is operated only when the pressure is equal to or greater than a predetermined pressure.

Here, an assembly order of the apparatus for automatically lengthening a calf muscle may be different from the aforementioned order.

Next, a state where the apparatus for automatically lengthening a calf muscle having the aforementioned configuration is used will be described.

First, after the lower leg and the foot of the user are accommodated within the lower leg accommodating member 21 and the foot accommodating part 30 of the lower leg fixing part 20, the lower leg of the user is fixed using the lower leg fixing members 22.

In addition, when the pressure detecting unit 40 receives the pressure from the heel of the user fixed to the lower leg fixing part 20 and the foot accommodating part 30, the pressure detecting unit transmits the pressure to the controller 60, and the controller 60 controls the rotation driving unit 50 and the power supply 70 to rotate the foot accommodating part 30.

That is, when the rotation driving unit 50 receives the power through the power supply 70 in response to the signal of the controller 60, the rod 52*a* and the rotational shaft 52*b* of the starting motor 53 are moved forward to be fastened to the rotational body 52, and rotates the foot accommodating part 30 upward.

In such a state, the foot accommodated in the foot accommodating part 30 faces upward, and a muscle of the lower leg accommodated in the lower leg fixing part 20 is lengthened.

Thereafter, the foot accommodating part 30 is positioned at its original position after a predetermined time or according to the manipulation of the user, and when the user decreases the pressure transmitted to the pressure detecting unit 40, the pressure detecting unit 40 transmits the decreased pressure signal value to the controller 60, and the controller 60 shuts off the power supply 70 in response to the signal of the pressure detecting unit 40.

At this time, the rod 52*a* and the rotational shaft 52*b* of the starting motor 53 is retreated, and the foot accommodating part 30 is automatically returned to its original position by the weight of the user.

According to the apparatus for automatically lengthening a calf muscle, it is possible to relax fatigue and tension of a calf muscle of a worker who works standing up for a long time or a woman wearing high heels.

Although the specific shape and direction of the apparatus for automatically lengthening a calf muscle have been described with reference to the accompanying drawing, it is to be appreciated that those skilled in the art can change or modify the present disclosure and the changes or modifications fall within the claims of the present disclosure.

From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

What is claimed is:

1. An apparatus for automatically lengthening a calf muscle comprising:

a lower leg fixing part that covers the entire lower leg;

a foot accommodating part that is rotatably coupled to a lower part of the lower leg fixing part;

a pressure detecting unit that is attached to a heel part of the foot accommodating part to detect a pressure;

a rotation driving unit that is attached to connection portions of the lower leg fixing part and the foot accommodating part to rotate the foot accommodating part depending on an operation of the pressure detecting unit;

a controller that controls the rotation driving unit in response to a signal transmitted from the pressure detecting unit; and a power supply that supplies a power to the rotation driving unit in response to a signal of the controller, wherein the rotation driving unit comprises:

a driving case that is attached to an outer surface of the lower leg fixing part;

rotational bodies that are disposed at overlapped portions of the lower leg fixing part and the foot accommodating part to rotate the foot accommodating part at the time of rotating; and a pair of starting motors that is attached to the driving case, wherein each motor of the pair of starting motors is positioned in the same like with a rotational body of the rotational bodies, wherein each of the rotational bodies includes a rotating member that is attached to a connection portion of the lower leg fixing part to be rotated in place relative to the connection portion of the lower leg fixing part, and a fixing member that is attached to a connection portion of the foot accommodating part, wherein the fixing member has an outer surface of a polygonal shape configured to fix the fixing member relative to the connection portion of the foot accommodating part, wherein the rotating member is coupled to the fixing member.

2. The apparatus for automatically lengthening a calf muscle of claim 1, wherein a dorsiflexion part is formed at the lower part of the lower leg fixing part to be inclined so as to restrict a rotation angle of the foot accommodating part.

3. The apparatus for automatically lengthening a calf muscle of claim 1, wherein the lower leg fixing part includes a lower leg accommodating member that has an opened front surface and accommodates a lower leg, and lower leg fixing members that are attached to the front surface at a predetermined distance relative to each other to fix the lower leg accommodating member.

4. The apparatus for automatically lengthening a calf muscle of claim 1, wherein the polygonal shape of the outer surface of the fixing member is a gear or spline with fixing protrusions distributed at the outer surface of the fixing member at a predetermined distance relative to each other.

5. The apparatus for automatically lengthening a calf muscle of claim 1, wherein the starting motors are configured to drive the rotational bodies in a forward or reverse direction.

* * * * *